US005258739A

United States Patent [19]

DeLuca et al.

[11] Patent Number: 5,258,739

[45] Date of Patent: Nov. 2, 1993

[54] EFFICIENT MESSAGE STORAGE WITHIN A SELECTIVE CALL RECEIVER

[75] Inventors: Joan S. DeLuca, Boca Raton; Amy Kabcenell, Highland Beach; Michael J. DeLuca, Boca Raton, all of Fla.

[73] Assignee: Motorola, Inc., Schaumburg, Ill.

[21] Appl. No.: 684,475

[22] Filed: Apr. 11, 1991

Related U.S. Application Data

[63] Continuation of Ser. No. 435,145, Nov. 9, 1989, abandoned.

[51] Int. Cl.[5] ..... G08B 5/22

[52] U.S. Cl. ..... 340/825.44; 340/311.1; 455/38.1

[58] Field of Search ..... 340/825.44, 311.1; 455/38.1; 379/57

[56] References Cited

U.S. PATENT DOCUMENTS

| | | | |
|---|---|---|---|
| 3,976,995 | 8/1976 | Sebestyen | 340/825.44 |
| 4,336,524 | 6/1982 | Levine | 455/31 |
| 4,382,256 | 5/1983 | Nagata | 340/825.44 |
| 4,480,253 | 10/1984 | Anderson | 340/825.44 |
| 4,742,516 | 5/1988 | Yamaguchi | 340/825.44 |
| 4,766,434 | 8/1988 | Matai et al. | 340/825.44 |
| 4,797,929 | 1/1989 | Gerson et al. . | |
| 4,940,975 | 7/1990 | Ide et al. | 340/825.44 |
| 4,956,641 | 9/1990 | Matai et al. | 340/825.44 |
| 4,988,991 | 1/1991 | Motegi | 340/825.44 |
| 5,072,444 | 12/1991 | Breeden et al. | 340/825.44 |

*Primary Examiner*—Donald J. Yusko
*Assistant Examiner*—Michael Horabik
*Attorney, Agent, or Firm*—Kelly A. Gardner; Thomas G. Berry; Daniel R. Collopy

[57] ABSTRACT

A selective call receiver (10) for receiving a radio frequency message having message characters includes a memory (14) for storing information including predetermined message characters and processing circuitry (13) for determining an amount of available space within the memory (14) in response to reception of a message. When the available space within the memory (14) is insufficient for storage of the message characters included within the received message, one or more of the message characters included within the received message is deleted prior to storing the received message. Alternatively, one or more message characters included within a previously stored message may be deleted prior to storing the received message.

9 Claims, 9 Drawing Sheets

— PRIOR ART —

| CONDENSABLE WORDS | CONTROL CHARACTER |
|---|---|
| ~ARRIVAL | ^A |
| ~CONFIRMED | ^B |
| ~DINNER | ^C |
| ~HOME | ^D |
| ~LUNCH | ^E |
| ~MEET | ^F |
| ~OFFICE | ^G |
| ~PLEASE | ^H |
| ~TELEPHONE | ^I |
| ~URGENT | ^J |
| ~WIFE | ^K |
| ~YOUR | ^L |

~ = ASCII "SPACE"

| CONDENSABLE WORDS | ASCII RESULT |
|---|---|
| ~ZERO ..... | ~0 |
| ~ONE ..... | ~1 |
| ECT. | |
| ~HUNDRED ..... | 00 |
| ECT. | |
| ~AND ..... | ~& |
| ~NUMBER ..... | ~# |
| ~DOLLAR(S) ... | ~$ |
| ~PERCENT ..... | ~% |
| ~PLUS ..... | ~+ |
| ~O'CLOCK ..... | ~:00 |

~ = ASCII "SPACE"

| NO CONDENSING | TYPE A CONDENSING | TYPE A & B CONDENSING | TYPE A, B & C CONDENSING |
|---|---|---|---|
| ***MESSAGE DISPLAY SCREENS*** | ***MESSAGE DISPLAY SCREENS*** | ***MESSAGE DISPLAY SCREENS*** | ***MESSAGE DISPLAY SCREENS*** |
| 1 YOUR CONFIRMED ARRIVAL IS AT | 1 YOUR CONFIRMED ARRIVAL IS AT | 1 YOUR CONFIRMED ARRIVAL IS AT | 1 YOUR CONFIRMED ARRIVAL 5:00 |
| 2 FIVE O'CLOCK, MEET YOUR WIFE | 2 FIVE O'CLOCK, MEET YOUR WIFE | 2 5:00, MEET YOUR WIFE FOR DINNER | 2 MEET YOUR WIFE FOR DINNER HOME |
| 3 FOR DINNER AT HOME, AND PLEASE | 3 FOR DINNER AT HOME, AND PLEASE | 3 AT HOME, & PLEASE TELEPHONE | 3 & PLEASE TELEPHONE YOUR |
| 4 TELEPHONE YOUR OFFICE AT | 4 TELEPHONE YOUR OFFICE AT | 4 YOUR OFFICE AT 1-305-555-1212 | 4 OFFICE 13055551212 |
| 5 1-305-555-1212 | 5 1-305-555-1212 | | |
| ***MESSAGE AS STORED IN MEMORY*** | ***MESSAGE AS STORED IN MEMORY*** | ***MESSAGE AS STORED IN MEMORY*** | ***MESSAGE AS STORED IN MEMORY*** |
| YOUR CONFIRMED ARRIVAL IS AT FIVE O'CLOCK, MEET YOUR WIFE FOR DINNER AT HOME, AND PLEASE TELEPHONE YOUR OFFICE AT 1-305-555-1212* | ^L^B^A IS AT FIVE O'CLOCK,^F^L^K FOR^C AT^D, AND^H^I^L^G AT ^O<br>1-305-555-1212^O<br>* | ^L^B^A IS AT 5:00,^F^L^K FOR^C AT^D, &^H^I^L^G AT ^O<br>1-305-555-1212^O<br>* | ^L^B^A 5:00,^F^L^K FOR^C^D, &^H^I^L^G ^O<br>13055551212^O<br>* |
| 129 ASCII CHARS | 62 ASCII CHARS<br>16 BCD CHARS<br>1 ASCII | 52 ASCII CHARS<br>16 BCD CHARS<br>1 ASCII | 40 ASCII CHARS<br>13 BCD CHARS<br>1 ASCII |
| 903 BITS = TOTAL MEM = 129 X 7 | 505 BITS = TOTAL MEM = (62+1) X 7 + 16 X 4 | 435 BITS = TOTAL MEM = (52+1) X 7 + 16 X 4 | 339 BITS = TOTAL MEM = (40+1) X 7 + 13 X 4 |

*FIG. 14*

EFFICIENT MESSAGE STORAGE WITHIN A SELECTIVE CALL RECEIVER

This is a continuation of U.S. Patent application Ser. No. 07/435,145 filed Nov. 9, 1989, now abandoned.

FIELD OF THE INVENTION

This invention relates in general to selective call receivers and more particularly to a method of storing messages in a selective call receiver.

BACKGROUND OF THE INVENTION

Selective call radio receivers such as pagers alert a user of a received message. Such devices generally incorporate a radio receiver capable of producing either an audible alert which may be heard by the user or a tactile alert such as a vibrating sensation which may be felt by the user. Some pagers provide the additional features of a voice message following the alert or a message visually displayed on a screen.

Each selective call receiver is identified by a specific address that typically precedes each message. When a selective call receiver receives a message including the selective call receiver address, the message is stored within a memory.

However, when the memory is already occupied by previously received messages and another message is received, typically the earliest received message is deleted and the newly received message is stored in its place. This deletion may be undesirable since the user of the selective call receiver may not want the earliest received message to be deleted or the message may contain information that the user will require at a later time.

Thus, what is needed is an improved method of storing and deleting messages.

SUMMARY OF THE INVENTION

According to an aspect of the present invention, in a selective call receiver having a memory, a method for reducing the size of messages comprises the steps of receiving a radio frequency message comprising message characters and determining that an amount of available space within the memory is insufficient for storage of the message characters. The method further comprises the steps of comparing, in response to the determining step, the message characters with predetermined message characters and deleting one or more of the message characters included within the message in accordance with the comparing step.

According to another aspect of the present invention, a selective call receiver for receiving a radio frequency message having message characters comprises a memory for storing information including predetermined message characters and determining circuitry coupled to the memory for determining an amount of available space within the memory in response to reception of the message. Comparing circuitry coupled to the determining circuitry compares the message characters with the predetermined message characters in response to the determining circuitry determining that the amount of available space within the memory is insufficient for storage of the message characters. Deletion circuitry coupled to the memory and the comparing circuitry deletes at least one message character in accordance with the comparison performed by the comparing circuitry.

BRIEF DESCRIPTION OF THE DRAWINGS

FIG. 14 is a chart illustrating an example for each type of condensing.

DETAILED DESCRIPTION OF THE INVENTION

Figure 1:
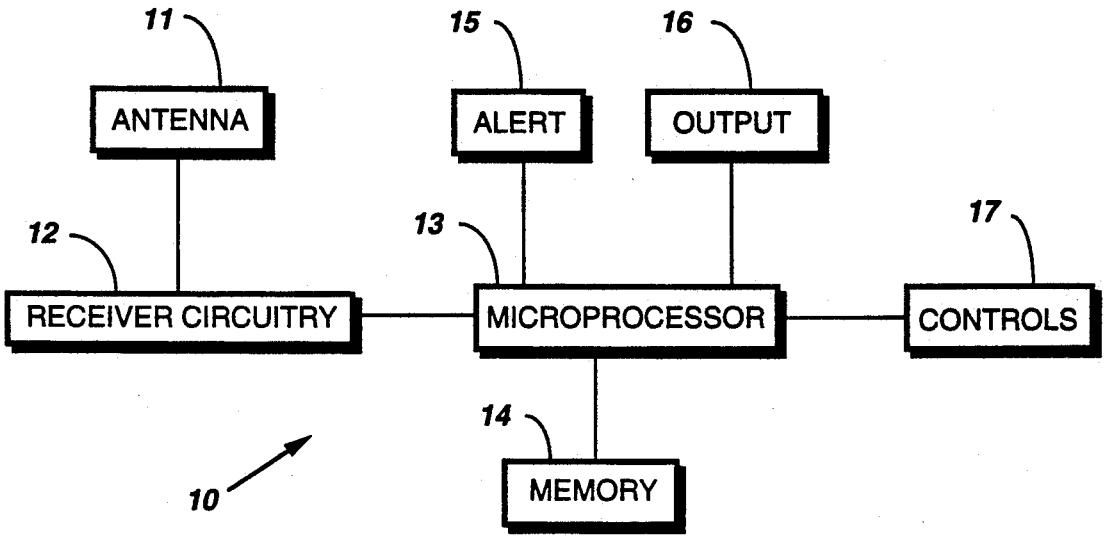
FIG. 1 is a block diagram of a known selective call receiver.

Referring to FIG. 1, an electronic device such as a selective call receiver 10 comprises an antenna 11 for receiving signals coupled to a receiver circuit 12 which demodulates the signals received. A memory 14 is coupled to a microprocessor 13 for storing those messages containing the address of the selective call receiver as determined by the microprocessor 13. The microprocessor 13 also controls the storing and recalling of those messages as explained hereinafter. An alert device 15 provides an alert, i.e., audible, visual or tactile, to the user that a message has been received and is ready to be presented. An output device 16 may be, for example, a visual display such as a liquid crystal display controlled by the microprocessor 13. The controls 17 allow the user to command the microprocessor 13 to perform the selective call receiver operations well known to those skilled in the art and may include control switches such as on/off control, function control, select, cursor movement, etc. For a more detailed description of the structure and operation of a selective call radio paging receiver of the type shown in FIG. 1, reference is made to U.S. Pat. No. 4,518,961, U.S. Pat. No. 4,649,538, and U.S. Pat. No. 4,755,816, all commonly assigned to the assignee of the present invention, and the teachings of which are hereby incorporated by reference.

Messages associated with a predetermined address for the particular selective call receiver are stored in the memory 14. Conventionally, when the memory 14 becomes fully occupied, there is no space available for the next received message. Fully occupied and filled to capacity as used herein when referring to the memory 14 mean that insufficient memory remains to receive another message. The present invention overcomes this problem by reducing the memory space occupied by the previously stored messages or by the message as it is received. Although several other methods of accomplishing this reduction would fall within the invention, four embodiments will be described. These embodiments include manual delete, automatic truncate, manual condense, and automatic condense.

Figure 2:
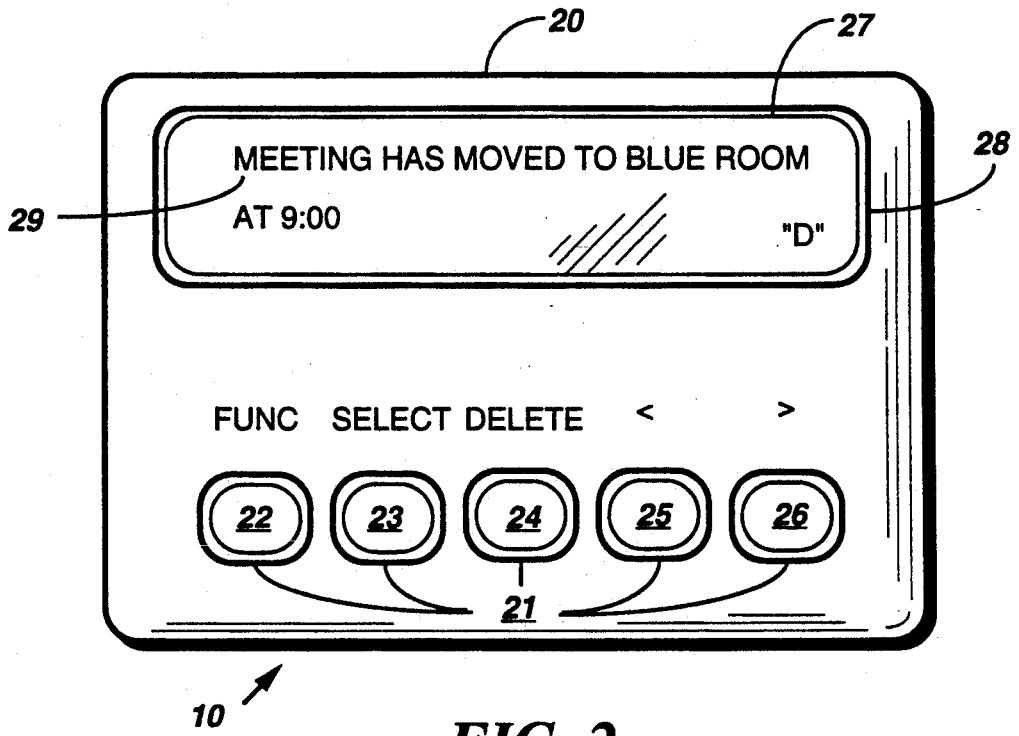
FIG. 2 is a top view of selective call receiver in accordance with the present invention.

Referring to FIG. 2, the selective call receiver 10 comprises a housing 20 including openings 21 therein with user control buttons 22, 23, 24, 25 and 26 accessible therethrough. A display device 27 such as a liquid crystal display (LCD) for a two line alphanumeric display is viewable through another opening 28. A cursor 29 is moved one position to the left for each depression of the user selectable directional button 25 and one position to the right for each depression of the user selectable directional button 26. By depressing the function button 22, a particular function such as manual delete "D" will be illustrated on the display 27. The select button 23 allows the user to select the illustrated function. The delete button 24 deletes the selected characters.

Figure 3:
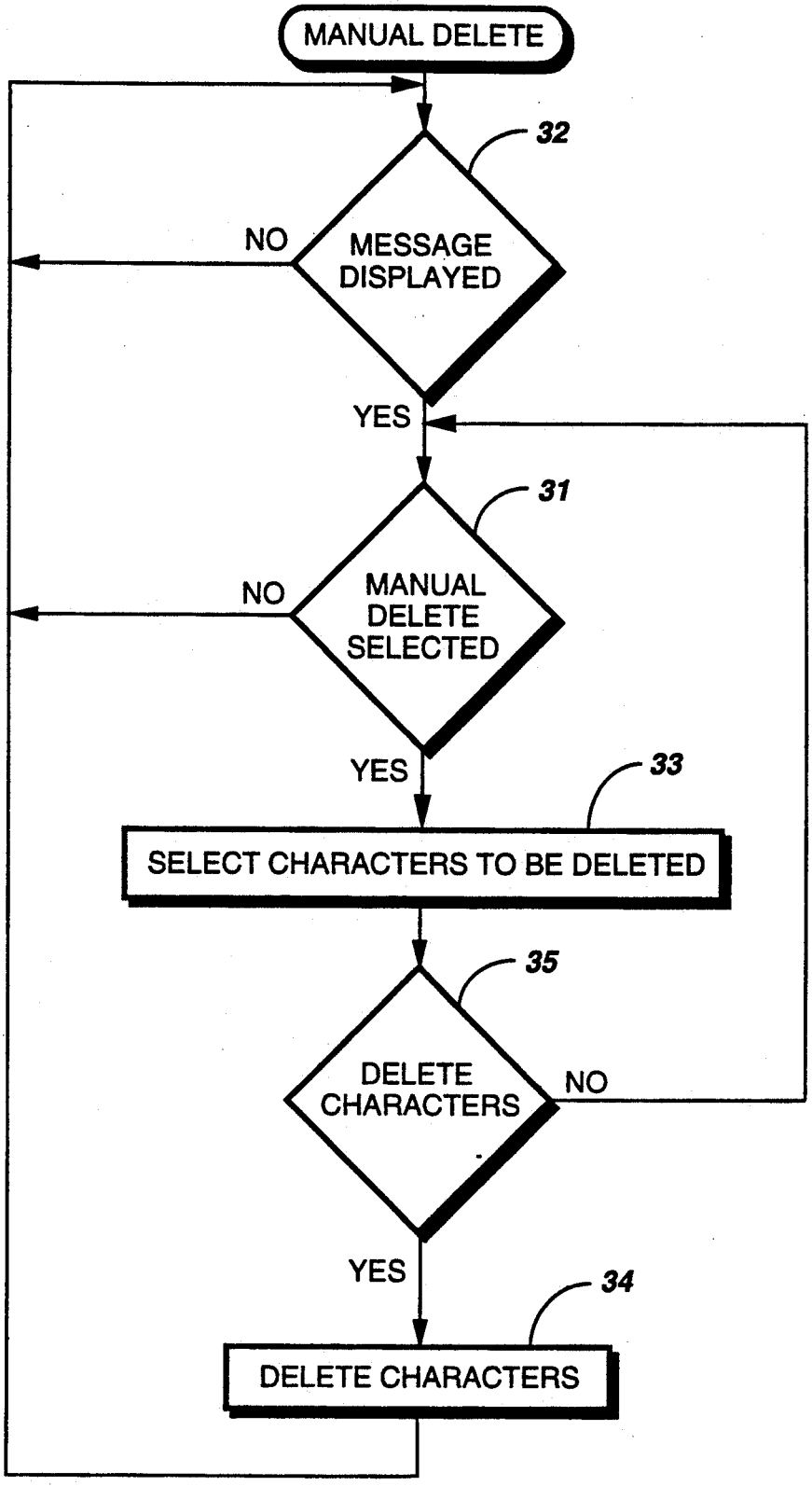
FIG. 3 is a flow chart illustrating a manual delete embodiment.

Referring to FIG. 3, the embodiment comprising the manual delete may be accomplished by the user generally at any time whether or not the memory 14 is fully occupied by received messages. However, it should be accomplished when the memory 14 is fully occupied and prior to receipt of a new message. The output 16 in this embodiment may comprise a visual display 27. The process is initiated by selecting the manual delete 31 by pressing the function button 22 when a message is displayed 32. The characters to be deleted are selected 33 by moving the cursor 29 on the display 28 and selecting (highlighting) those characters.

Figure 4A:
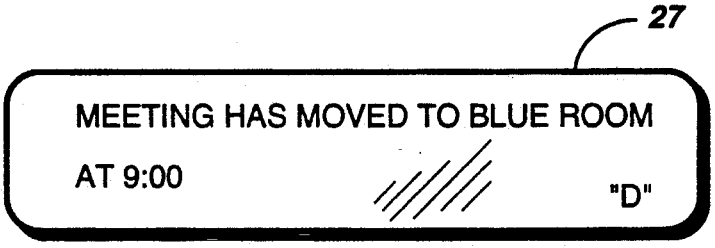
FIGS. 4A, 4B, and 4C show three examples of a message on a display of the selective call receiver as the manual delete embodiment is accomplished.
Figure 4B:
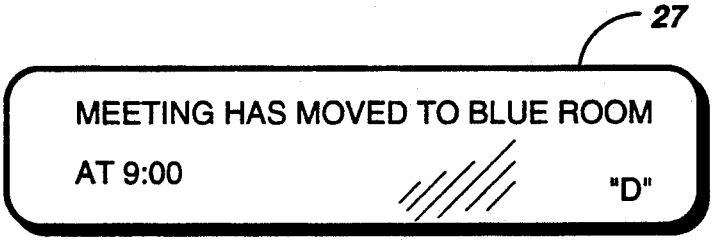
Figure 4C:
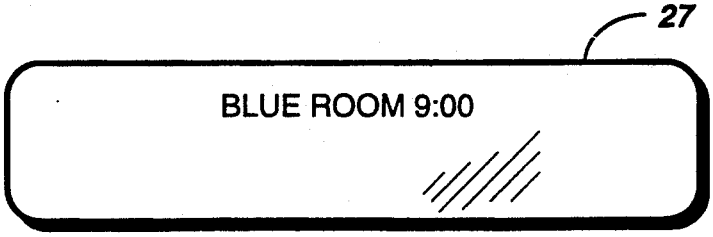

For example, referring to FIG. 4(A), the cursor 29 has been moved under the letter "H" and the select button 23 has been pushed to highlight the "H". In FIG. 4(B), the words "MEETING HAS MOVED TO" and "AT" have been highlighted in a similar manner. In FIG. 4(C), the highlighted words "MEETING HAS MOVED TO" and "AT" have been deleted 34 by pushing the delete button 24, step 35. Therefore, it may be seen that several characters of a message may be manually deleted without destroying the content of the message while providing additional space within the memory 14 for the receipt of additional messages. As in each of the four described embodiments, an icon may be displayed informing the user that an edited message is displayed. Additionally, the icon may convey the type of editing used.

Thus, FIG. 4 shows a message being reduced in size while maintaining only essential information. The received message "MEETING HAS MOVED TO BLUE ROOM AT 9:00" has a total of 38 ASCII characters, while the reduced message "BLUE ROOM 9:00" has a total of 14 ASCII characters, thereby freeing memory space for 24 ASCII characters of a subsequently received message while maintaining only the user determined essential information.

Figure 5:
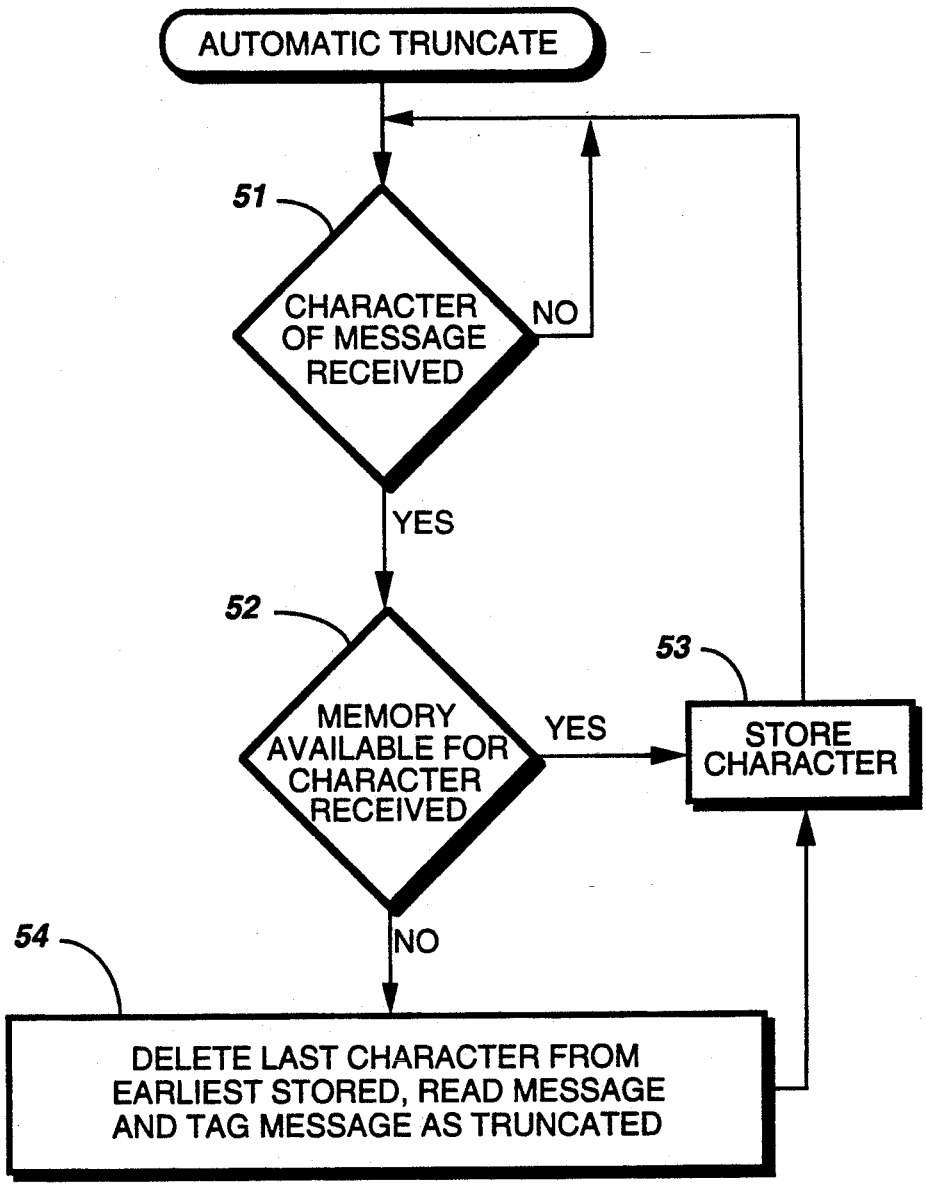
FIG. 5 is a flow chart illustrating an automatic truncate embodiment.

Referring to FIG. 5, a flow chart for the automatic truncate embodiment describes the process for automatically truncating sufficient characters from the earliest stored, read message in the memory 14 in order to be able to store a newly received message when the memory 14 is filled to capacity. When the first character of a message is received 51, the microprocessor 13 checks the memory 14 for space available to store the received character 52. If space is available, the character is stored 53. If space is not available 52, the last character from the earliest stored, read message is deleted 54 and the character received is stored 53. This process is repeated until the entire message has been received, i.e., a character of the message is not received 51. This process takes the oldest message in the memory 14 and selectively deletes the last characters in that message until the newly received message is stored. Generally, only a part of the earliest stored, unprotected message will be deleted, the remaining part being tagged as truncated for the user to see on subsequent reads. A message with a protected status will not be truncated.

Figure 6:
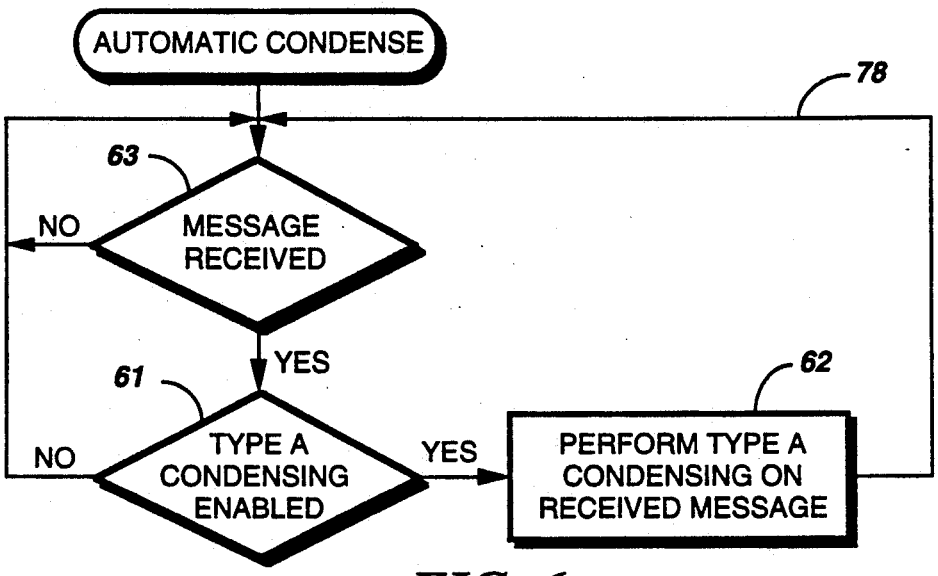
FIG. 6 is a flow chart illustrating an automatic condense embodiment.

Referring to FIG. 6, the automatic condense embodiment describes the selection of type A condensing of the characters or words of a message stored in the memory 14 for providing space in the memory 14 for receipt of an additional message. Alternatively, the message being received could be condensed in this manner. The type A condensing may be selectively enabled 61 by the user or arbitrarily enabled on every message and is performed 62 on a message when it is received 63.

Figure 7:
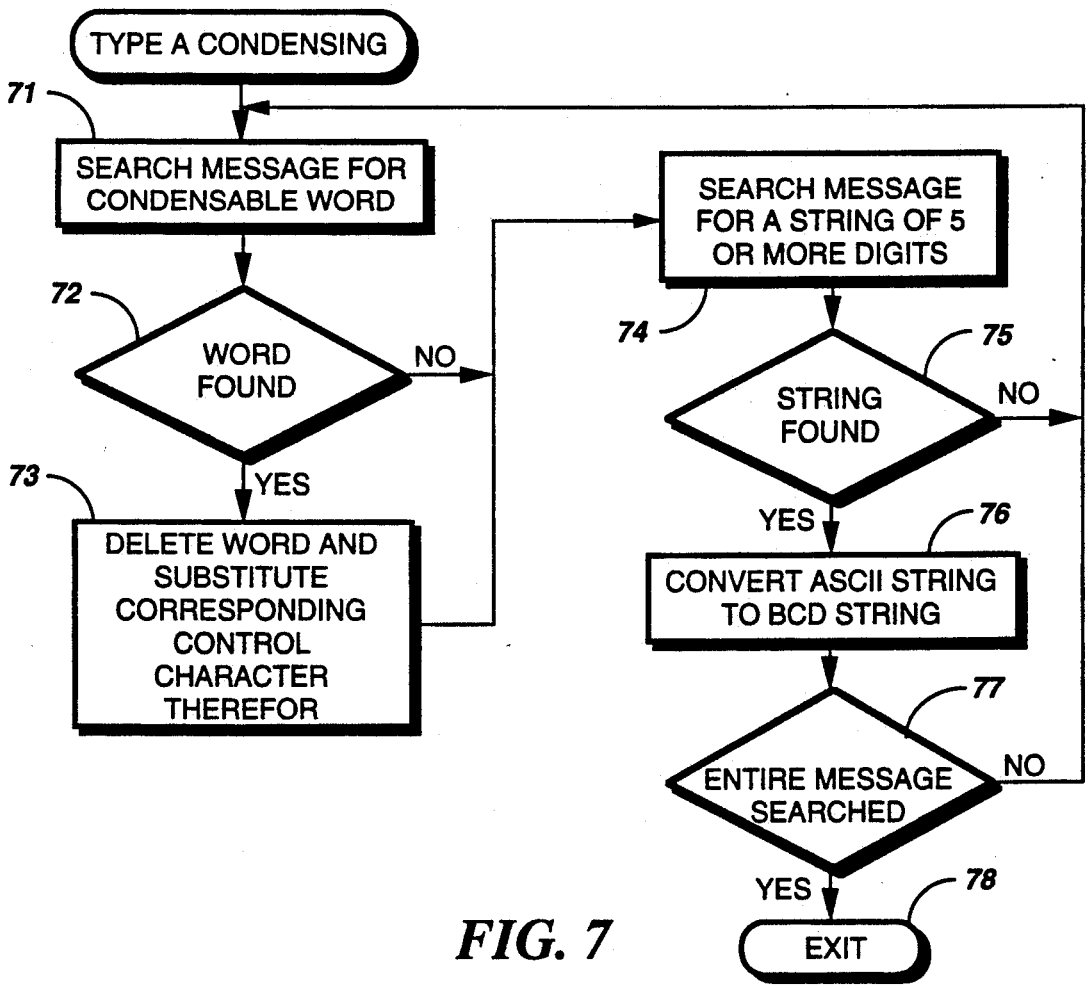
FIG. 7 is a flow chart illustrating a type A condensing of the automatic condense embodiment.
Figures 8, 9:
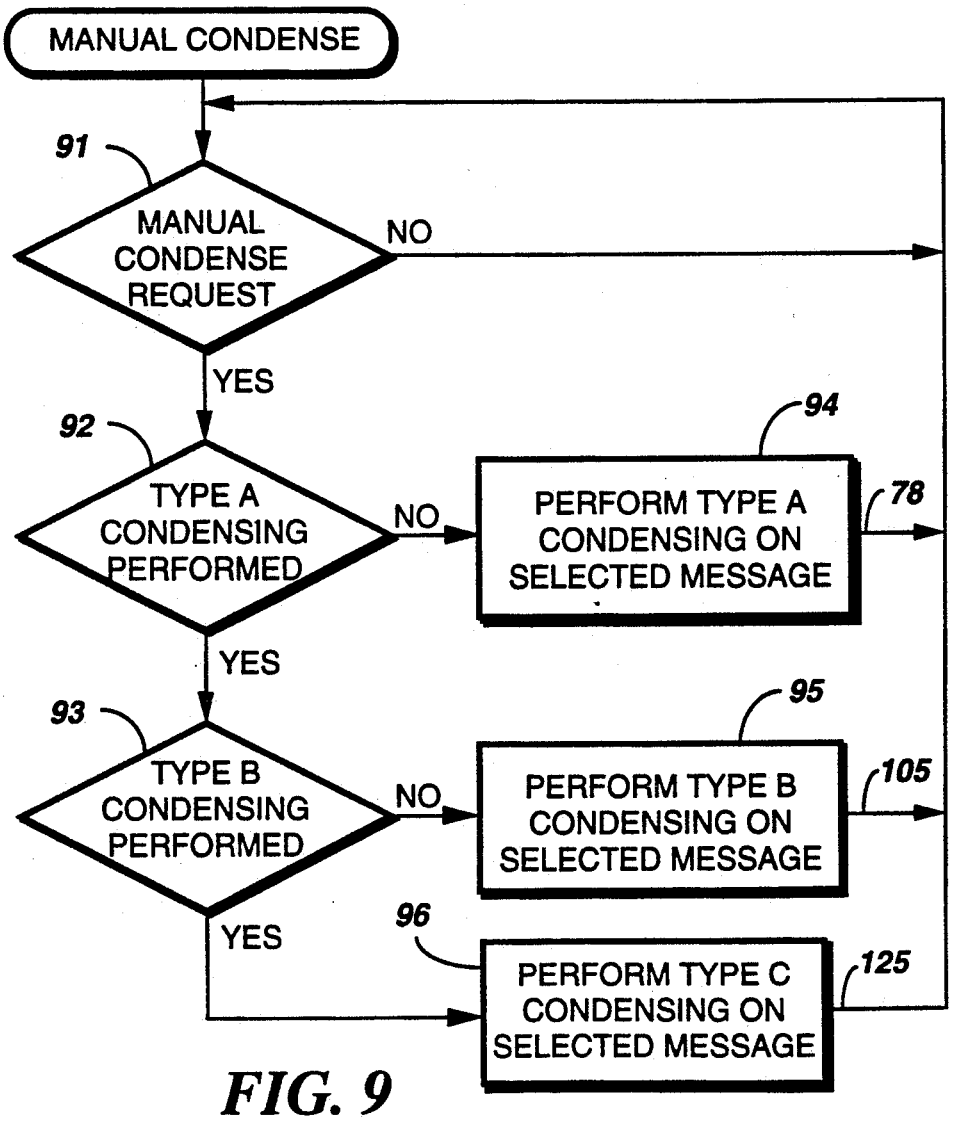
FIG. 8 is a table of condensable words for type A condensing.
FIG. 9 is a flow chart illustrating a manual condense embodiment.

Referring to FIG. 7, the type A condensing embodiment initially searches a message for a condensable word 71. If a condensable word is found 72, the word is deleted and a corresponding control character is substituted therefor 73. A list of sample corresponding control characters or signals is illustrated in FIG. 8. For example, a "^A" is a representation for the word "ARRIVAL", and a "^J" would be substituted for the word "URGENT". After this substitution 73, the message is searched for a string of five or more BCD equivalent characters 74, and if found 75, the string, having been received or stored in ASCII format, is converted into a BCD string 76. The program will then return to step 71 to search for another condensable word. However, if the entire message has been searched 77, the program will exit 78 to await receipt of another message 63. It should be seen that slight changes in the flow chart of FIG. 7 would allow for searching of the entire message for condensable words first and then searching of the entire message for digit strings. Furthermore, portions of the message could be searched as it is received and the appropriate substitutions made before the entire message is received. Upon displaying of a type A condensed message, each character is tested for a control sequence, and if found, the table of FIG. 8 is used to display the word corresponding to the control character.

Referring to FIG. 9, the manual condense embodiment describes the selection of the types A, B, and C condensing of the characters or words of a message stored in the memory 14 for providing space in the memory 14 for receipt of an additional message. The manual condense embodiment is selected 91 by pushing the select button 23 (FIG. 2) after displaying an appropriate icon on the display 27 by pushing the function button 22. The types A, B, and C are selected by the user in steps 92 and 93 after which the selected type A, B, or C is performed, steps 94, 95, and 96, respectively. These selections are also made by utilizing the function and select buttons 22 and 23, respectively. The type A embodiment is the same as previously described by referring to FIG. 7. Furthermore, those skilled in the art would appreciate that the automatic condense embodiment may select any of type A, B or C condensing or any combination thereof.

Figures 10, 11:
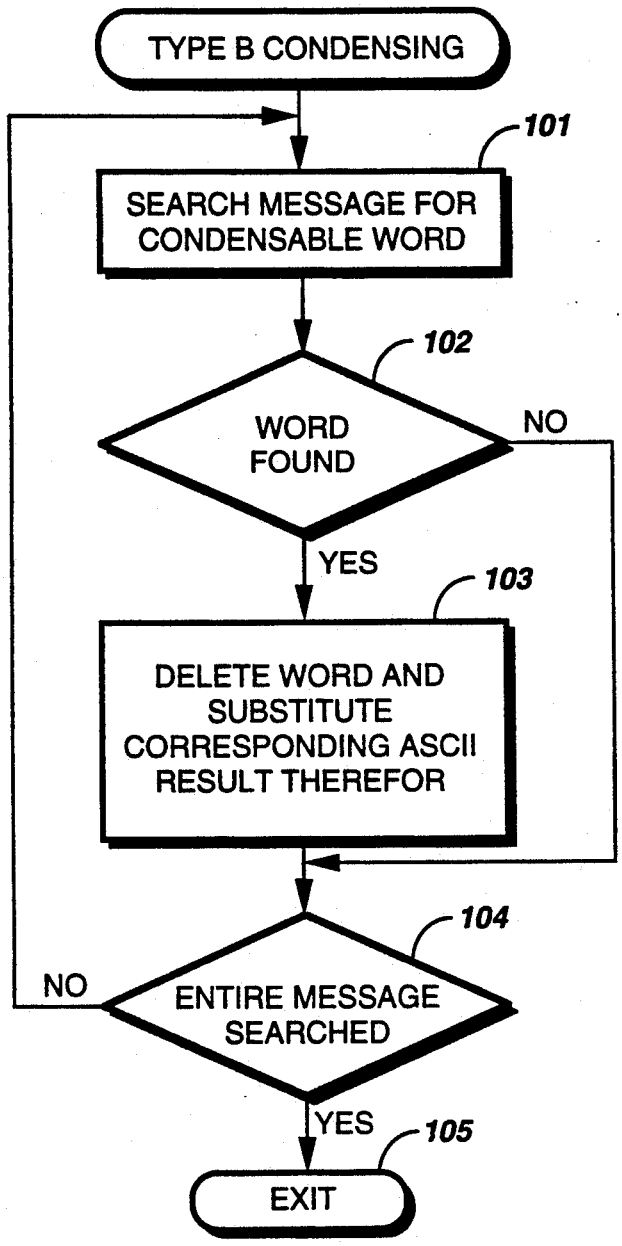
FIG. 10 is a flow chart illustrating a type B condensing of the manual condense embodiment.
FIG. 11 is a table of condensable words for type B condensing.

Referring to FIG. 10, the type B condensing searches the message for a condensable word 101. FIG. 11 gives examples of condensable words, i.e., an ASCII "~0" is substituted for the word "ZERO" and an ASCII "~#"

is substituted for the word "NUMBER". If a condensable word is found 102, the word is found and the ASCII result is substituted therefor 103. This process repeats until the entire message has been searched 104, with the process exiting 105 until of the next message 63.

Figure 12:
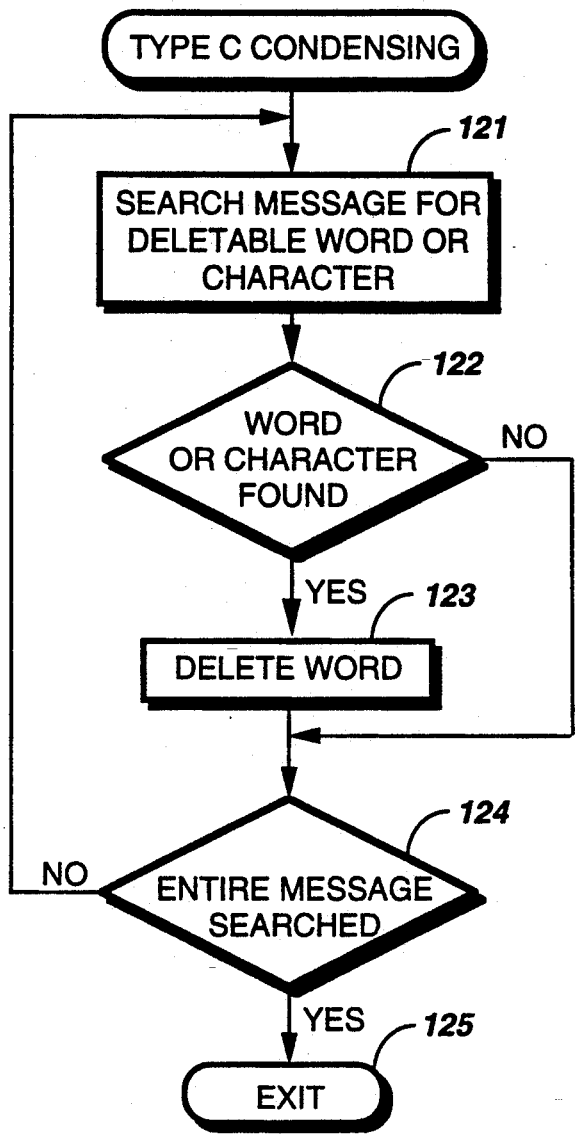
FIG. 12 is a flow chart illustrating a type C condensing of the manual condense embodiment.
Figure 13:
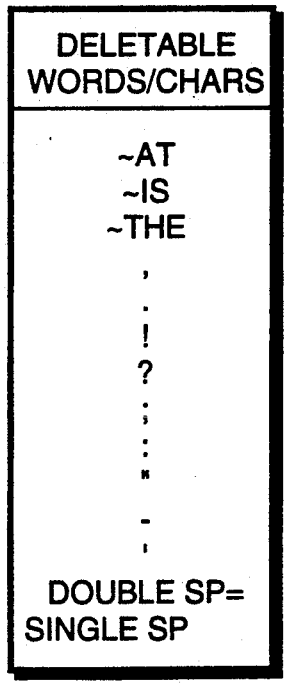
FIG. 13 is a table of deletable words for type C condensing.

Referring to FIG. 12, the type C condensing searches the message for a deletable word or character 121. FIG. 13 gives examples of deletable words, i.e., the word "AT" or the character "!". If a deletable word is found 122, the word is deleted 123 and the process is repeated until the entire message is searched 124, with the process exiting 125 until receipt of the next message.

Referring to FIG. 14, examples of no condensing and types A, B and C condensing are shown. For the case of no condensing shown in the first column, the complete message comprises 129 ASCII characters or 903 bits. In comparison, the type A condensing shown in the second column, with control characters substituted for the condensable words (see FIG. 8), the complete message comprises 63 ASCII characters and 16 BCD characters, or 505 total bits. For the combined type A and B condensing shown in the third column, with the ASCII result substituted for the condensable words (see FIG. 11), the complete message comprises 53 ASCII characters and 16 BCD characters, or 435 total bits. For the combined type A, B and C condensing shown in the fourth column, with the appropriate words and characters deleted (FIG. 13), the complete message comprises 41 ASCII characters and 13 BCD characters, or 339 total bits. Each transfer from ASCII to BCD or from BCD to ASCII is triggered by the ^O.

In summary, an improved method of storing messages within a selective call receiver reduces the memory space occupied by at least one message stored within the memory either upon receipt of another message by the selective call receiver when the memory capacity is substantially occupied by previously received messages or in response to manual input. Alternatively, the memory requirement of a message may be reduced as it is received.

We claim:

1. In a selective call receiver having a memory, a method for reducing the size of messages comprising the steps of:

receiving a radio frequency message comprising message characters;

determining that an amount of available space within the memory is insufficient for storage of the message characters;

comparing, in response to the determining step, the message characters with predetermined message characters; and deleting one or more of the message characters included within the message in accordance with the comparing step.

2. The method according to claim 1, further comprising, subsequent to the comparing step, the step of:

determining whether at least one message character is equivalent to at least one predetermined message character.

3. The method according to claim 2 wherein the deleting step comprises the steps of:

substituting, if at least one message character is determined to be equivalent to at least one predetermined message character, the at least one message character with at least one substitute character associated with the at least one predetermined message character, the at least one substitute character occupying less memory space than the at least one message character; and storing the message, including the at least one substitute character, in the memory.

4. The method according to claim 3 wherein the at least one message character comprises at least one ASCII character and the substituting step comprises the step of:

substituting the at least one ASCII character with at least one BCD character.

5. The method according to claim 2, wherein the deleting step comprises the step of:

deleting, if at least one message character is determined to be equivalent to at least one predetermined message character, the at least one message character.

6. A selective call receiver for receiving a radio frequency message comprising message characters, the selective call receiver comprising:

memory means for storing information including predetermined message characters;

determining means coupled to the memory means for determining an amount of available space within the memory means in response to reception of the message;

comparing means coupled to the determining means for comparing the message characters with the predetermined message characters in response to the determining means determining that the amount of available space within the memory means is insufficient for storage of the message characters; and deletion means coupled to the memory means and the comparing means for deleting at least one message character in accordance with the comparison performed by the comparing means.

7. The selective call receiver according to claim 6 wherein the deletion means deletes the at least one message character in response to the comparing means determining that the at least one message character is equivalent to at least one predetermined message character.

8. The selective call receiver according to claim 7, wherein the deletion means further substitutes, in place of the at least one message character, at least one substitute character associated with the at least one predetermined message character, the at least one substitute character occupying less memory space than the at least one message character.

9. The selective call receiver according to claim 8 wherein the at least one message character comprises at least one ASCII character and the at least one substitute character comprises at least one BCD character.

* * * * *